US005194096A

United States Patent [19]

Holm

[11] Patent Number: 5,194,096

[45] Date of Patent: Mar. 16, 1993

[54] CARBURIZING TREATMENT OF A STEEL WITH REDUCTION OF THE HYDROGEN CONTENT IN THE CARBURIZED LAYER

[75] Inventor: Torsten Holm, Lidingo, Sweden

[73] Assignee: AGA Aktiebolag, Lidingo, Sweden

[21] Appl. No.: 781,146

[22] PCT Filed: Jun. 13, 1990

[86] PCT No.: PCT/SE90/00409

§ 371 Date: Dec. 24, 1991

§ 102(e) Date: Dec. 24, 1991

[87] PCT Pub. No.: WO91/00367

PCT Pub. Date: Jan. 10, 1991

[30] Foreign Application Priority Data

Jun. 30, 1989 [SE] Sweden ..... 8902365

[51] Int. Cl.[5] ..... C21D 1/06

[52] U.S. Cl. ..... 148/233; 148/235

[58] Field of Search ..... 148/235, 233, 210, 225, 148/229

[56] References Cited

U.S. PATENT DOCUMENTS

| | | | |
|---|---|---|---|
| 2,279,716 | 4/1942 | Nieman | 148/581 |
| 3,737,204 | 6/1972 | Burhardt | 308/241 |
| 4,201,600 | 5/1980 | Luiten et al. | 148/233 |
| 4,306,918 | 12/1981 | Kaspersma et al. | 148/233 |
| 4,597,807 | 7/1986 | Fenstermaker et al. | 148/233 |

FOREIGN PATENT DOCUMENTS

| | | |
|---|---|---|
| 2023064 | 12/1970 | Fed. Rep. of Germany . |
| 56-02009 | 7/1981 | Japan . |
| 2214196 | 8/1989 | United Kingdom . |

*Primary Examiner*—Deborah Yee

*Attorney, Agent, or Firm*—Calfee, Halter & Griswold

[57] ABSTRACT

Steel is carburized at a temperature within the austenitic range and in an atmosphere which comprises nitrogen, hydrogen and carbon monoxide, by lowering the hydrogen concentration in the treatment atmosphere prior to cooling steel in oil, salt or water, so as to reduce the hydrogen concentration in the carburization layer of the steel, by outward diffusion of hydrogen from the carburization layer.

4 Claims, No Drawings

CARBURIZING TREATMENT OF A STEEL WITH REDUCTION OF THE HYDROGEN CONTENT IN THE CARBURIZED LAYER

The present invention relates to a method of carburizing steel at a temperature within the austenitic range and in an atmosphere which comprises at least nitrogen, hydrogen and carbon monoxide.

Parts which are subjected to heavy stresses and strains, such as gear wheels, are often manufactured from steel which has been surface-hardened in a carburizing process.

In one known method for carburizing steel parts, the parts are cooled slowly in propane gas down to room temperature, so that the hydrogen taken-up in a carburization layer during the carburization process, through dissociation of propane gas, is able to diffuse outwards from the carburization layer, at least partially (U.S. Pat. No. 3,737,204). In those cases where the carburization cycle is followed by direct quenching of the parts in oil, salt or water, some of the atomic and molecular hydrogen will remain in the carburization layer. In the case of nickel-alloy steel, this hydrogen results in embrittment cf the hardened layer of the steel, which can result in dangerous crack formation.

Accordingly, one object of the present invention is to provide a method of carburizing steel parts, particularly parts comprised of low-alloyed nickel-alloyed steel, in which embrittlement of the hardened layer of said steel parts due to hydrogen dissociated from the carburizing gas is significantly avoided. Another object is to provide a method which can be defended economically.

These objects are achieved with a method having the characterizing features set forth in claim 1.

The object of the invention is achieved with the inventive method, by treating the steel parts in an inert gas, such as nitrogen, during the last phase of the carburizing process. The inert gas thus functions as a shielding gas so that neither oxidation, decarburization or carburization will take place on the surfaces of the steel parts. By flushing the furnace chamber with inert gas over a given period of time, the hydrogen concentration in the furnace atmosphere will decrease and part of the hydrogen taken up by the carburizing medium during carburization of the carburization layer is able to diffuse out of said layer.

Consequently, only an extremely short heat-treatment time is required for removal of hydrogen from the carburization layer, thereby rendering the inventive method highly economical, due to the short treatment time required and the low energy input.

Other advantageous features of the inventive method will be apparent from the dependent claims.

The steel parts are normally carburized at a temperature of between 900° and 980° C. Carburization is either effected in a batch-type furnace having integrated or separate cooling baths for cooling medium, such as oil, or in a continuous furnace with integrated cooling baths. The carburization atmosphere used is a carbon monoxide/hydrogen mixture, normally obtained through the dissociation of methanol. The carbon potential of the furnace atmosphere is normally regulated by adding hydrocarbons, such as propane or methane. The carburization time varies from between 1 and 100 hours. The undesirable absorption of hydrogen in the steel takes place during the carburizing process. The amount of hydrogen taken-up in the steel increases with increasing carburization times and with increasing proportions of hydrogen gas in the furnace atmosphere.

According to the present invention, steel parts are treated in the final stage of the carburization cycle and in the carburizing furnace with flowing nitrogen, which is introduced into the furnace at the same time as the introduction of the carburization atmosphere ceases. The steel parts are treated in the flowing nitrogen atmosphere for a period of time such that substantially all dissociated hydrogen will diffuse out from the carburization layer.

Instead of using dissociated methanol as the carburizing agent, another gas, e.g. methane, can be used which breaks down into carbon and hydrogen at the carburizing temperature used.

I claim:

1. A method for carburizing steel at a temperature within the austenitic range, comprising the steps of:

exposing the steel to a treatment atmosphere comprising nitrogen, hydrogen and carbon monoxide, substituting said treatment atmosphere with nitrogen prior to cooling or quenching the steel in oil, salt or water in order to reduce the hydrogen concentration in a carburization layer of the steel by outward diffusion of hydrogen from said carburized layer.

2. A method according to claim 1 in which in said step of exposing the steel to a treatment atmosphere the hydrogen and carbon monoxide are introduced into the treatment atmosphere through the dissociation of supplied methanol, and said step of substituting said treatment atmosphere with nitrogen is accomplished by terminating said supplied methanol.

3. A method according to claim 2, wherein said method is practiced in a batch furnace and further comprising the step of terminating the carburizing process by terminating the supply of methanol to said batch furnace and thereafter flushing said batch furnace with nitrogen gas.

4. A method according to claim 2, wherein said method is practiced in a continuous furnace, and further comprising the step of maintaining a nitrogen atmosphere in a last zone of the furnace before a cooling zone.

* * * * *